United States Patent [19]

Osborne et al.

[11] Patent Number: 4,789,301

[45] Date of Patent: Dec. 6, 1988

[54] LOW SPECIFIC SPEED PUMP CASING CONSTRUCTION

[75] Inventors: James C. Osborne, Seneca Falls; Patrick T. Murphy, Auburn, both of N.Y.

[73] Assignee: Goulds Pumps, Incorporated, Seneca Falls, N.Y.

[21] Appl. No.: 844,518

[22] Filed: Mar. 27, 1986

[51] Int. Cl.[4] ..... F04D 1/00

[52] U.S. Cl. ..... 415/206; 415/219 R; 29/527.6; 29/DIG. 26

[58] Field of Search ..... 415/204, 205, 206, 207, 415/DIG. 1, 200, 202, 219 B, 219 R; 29/156.4 R, 527.1, 527.5, 527.6, DIG. 26, 406

[56] References Cited

U.S. PATENT DOCUMENTS

| | | | |
|---|---|---|---|
| 1,619,285 | 3/1927 | Burks | 415/203 |
| 1,914,919 | 6/1933 | Heermans | 415/206 |
| 2,268,358 | 12/1941 | Turner | 415/204 |
| 2,656,096 | 10/1953 | Schwarz | 415/DIG. 1 |
| 2,814,434 | 11/1957 | Boyd | 415/206 |
| 3,139,264 | 6/1964 | Quenneville et al. | 415/203 |
| 3,386,244 | 6/1968 | Helmer | 415/200 |
| 3,547,554 | 12/1970 | Willette | 415/206 |
| 3,647,314 | 3/1972 | Laessig | 415/206 |
| 3,692,426 | 9/1972 | Ryall et al. | 415/206 |
| 3,758,227 | 9/1973 | Pollak et al. | 415/206 |
| 3,914,842 | 10/1975 | Bruckhoff et al. | 415/DIG. 3 |
| 4,066,381 | 1/1978 | Earnest | 415/202 |
| 4,097,188 | 6/1978 | Forster | 415/202 |
| 4,213,742 | 7/1980 | Henshaw | 415/206 |
| 4,230,645 | 10/1980 | Dodson | 29/527.6 |
| 4,422,822 | 12/1983 | Milleron | 415/206 |

FOREIGN PATENT DOCUMENTS

| | | | |
|---|---|---|---|
| 569707 | 1/1933 | Fed. Rep. of Germany | 415/206 |
| 399891 | 10/1933 | United Kingdom | 415/205 |
| WO85/04932 | 11/1985 | World Int. Prop. O. | 415/206 |

*Primary Examiner*—Robert E. Garrett
*Assistant Examiner*—John T. Kwon
*Attorney, Agent, or Firm*—Bean, Kauffman & Bean

[57] ABSTRACT

An improved low specific speed pump is disclosed, which provides for greater consistency of pump operating efficiencies obtainable by pumps of any given group of like size pumps. In the present pump, the internal dimensions of the pump chamber and discharge passage are enlarged to provide for a reduction in flow velocities therewithin compared to a conventional pump of a given design flow capacity and a controlled size restrictor is arranged adjacent the pump discharge in order to reduce the resultant increase in flow capacity to such given design value.

13 Claims, 1 Drawing Sheet

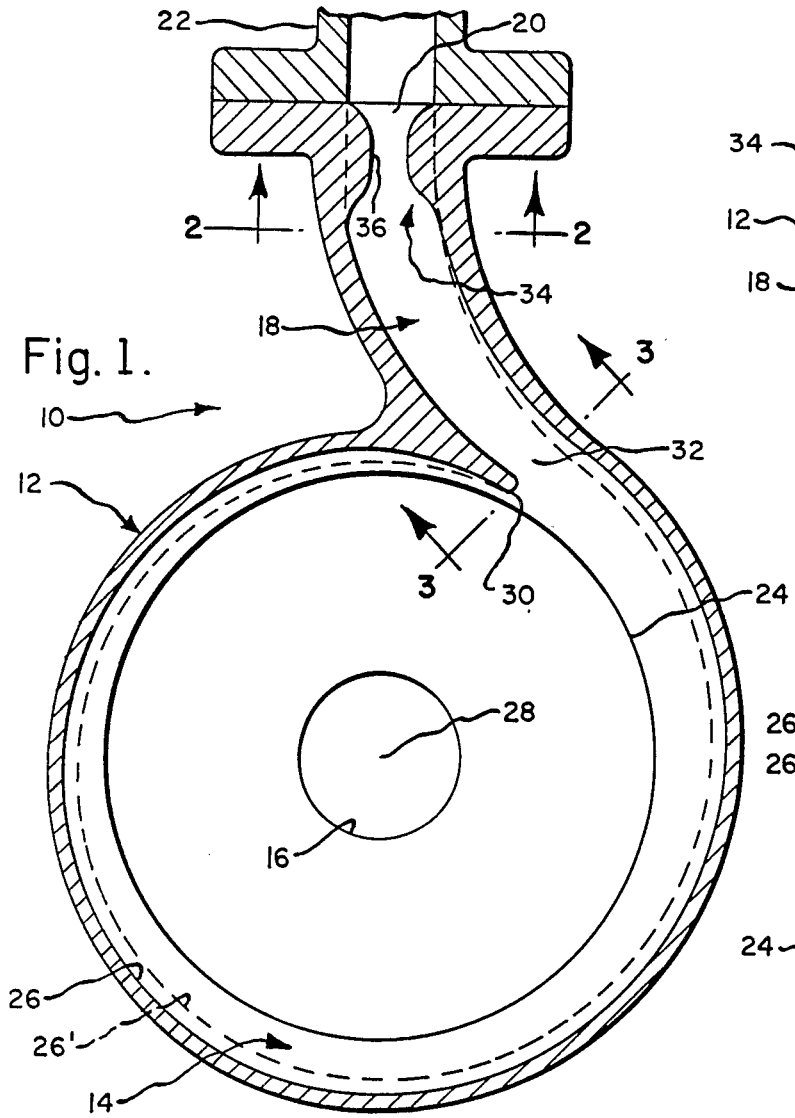
Fig. 1.
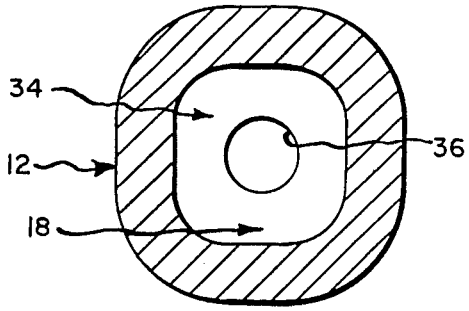
Fig. 2.
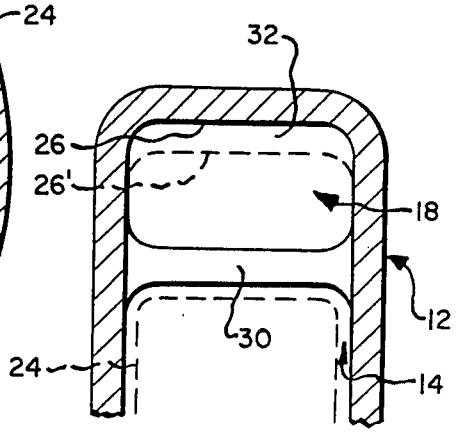
Fig. 3.
Fig. 4.
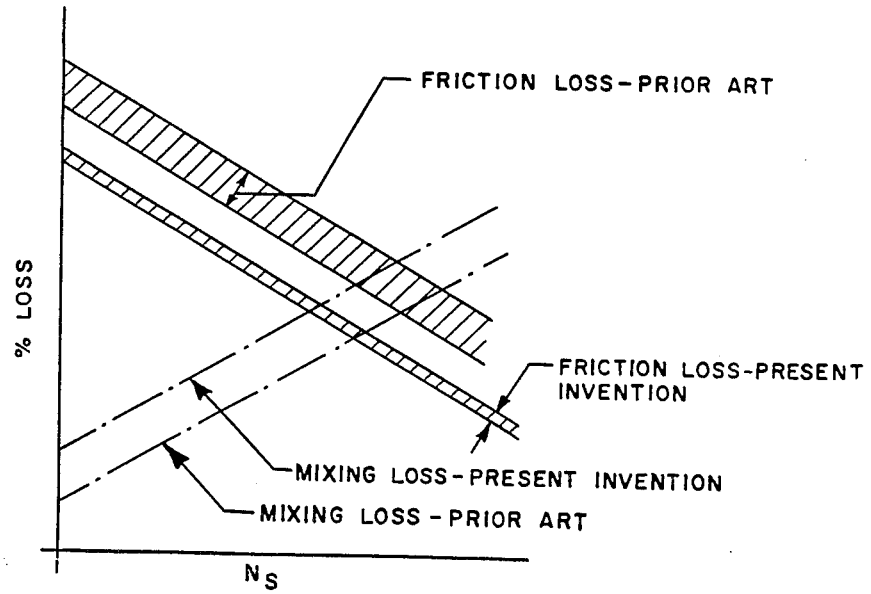

LOW SPECIFIC SPEED PUMP CASING CONSTRUCTION

BACKGROUND OF THE INVENTION

The invention relates to an improvement in low specific speed centrifugal pumps.

It is well known that frictional and mixing losses limit the efficiency of centrifugal pumps and that such losses decrease and increase, respectively, as specific speed increases. Specific speed is a design characteristic number designated as Ns and equals $$\frac{\sqrt{Q} \times \text{rpm}}{H^{\frac{3}{4}}},$$

wherein Ω is flow rate in gallons per minute, rpm is pump impeller revolutions per minute and H is the developed head of a pump in feet. For pumps having relatively low specific speeds, i.e., below the range of about 600–700, frictional losses exceed mixing losses and have a substantial effect on pump performance.

Low specific speed pumps provided with cast metal casings are known to be subject to substantial variations from design pump performance, due to substantial variations in frictional losses resulting from minor variations in size of the pump chamber and the surface finish thereof commonly encountered with metal castings. While it is possible to machine or hand work the internal surfaces of such pumps, with a view towards obtaining greater uniformity in size and surface finish in order to decrease the overall variations in efficiency, to do so adds substantially to manufacturing costs.

SUMMARY OF THE INVENTION

The present invention is specifically directed to the provision of low specific speed centrifugal pumps having relatively uniform performance characteristics.

In accordance with the present invention, the casing of an otherwise conventional low specific speed centrifugal pump is modified by enlarging its pump chamber and discharge passage, as compared to a like pump of a given output flow rate, and a restrictor is placed adjacent the outlet end of the discharge passage for purposes of throttling the flow output from the pump to a value equal to such given flow rate. The interior of the pump casing is enlarged as required to reduce the flow velocity of pump fluid therewithin to an extent such that minor variations in size and surface finish occasion substantially less friction loss than encountered in a comparable pump having the same discharge flow rate. The required percentage increase in the size of the pump interior will tend to increase, as specific speed decreases, in that interior flow velocities, and thus losses due to frictional effects tend to increase as the value of specific speed decreases.

In accordance with the present invention, the restrictor is defined by forming an accurately sized flow opening in a constriction formed adjacent the outlet end of the discharge passage, as an incident to casting of the pump casing. By selection of the size of drill used in forming the restrictor flow opening, a given size of pump may be modified to provide a family of pumps having different performance characteristics.

DRAWINGS

The nature and mode of operation of the present invention will now be more fully described in the following detailed description taken with the accompanying drawings wherein:

FIG. 1 is a sectional view taken through a conventional centerline discharge, relatively small size and relatively low specific speed centrifugal pump modified in accordance with the present invention;

FIG. 2 is a sectional view taken generally along the line 2—2 in FIG. 1.

FIG. 3 is a sectional view taken generally along the line 3—3 in FIG. 1; and FIG. 4 is a graph generally comparing friction and mixing losses encountered with a pump modified in accordance with the present invention and a conventional pump of like performance characteristics.

DETAILED DESCRIPTION

Reference is first made to FIG. 1, wherein 10 designates a centerline discharge, low specific speed centrifugal pump having a casing 12 formed to define a pump chamber 14, an inlet opening 16 connected to a fluid supply, not shown, and a discharge passage 18 having an outlet end 20 connected to a discharge pipe 22; and an impeller 24 mounted for rotation within pump chamber 14 for purposes of pumping fluid between inlet opening 16 and outlet end 20. Pump chamber 14 is shown as being of the volute type, wherein the distance between its radial, outer boundary surface 26 and the rotational axis 28 of impeller 24 progressively increases in the direction of rotation of the impeller from adjacent a cut-water 30 to an inlet end or throat area 32 of discharge passage 18. However, the present invention is also adpated for use in pumps of the type in which outer boundary surface 26 is disposed essentially concentrically of axis 28. Further, the present invention is equally adapted for use with pumps having closed or open impellers.

The full line showing in FIGS. 1–3 depicts a pump formed in accordance with the present invention, which differs from a known pump having the same operating characteristics principally with respect to the internal size and shape of its pump chamber and discharge passage. For purposes of comparison, broken lines 26' are used in FIGS. 1 and 3 to indicate the placement of the outer boundary wall of the known pump.

By referring to FIG. 4, it will be understood that for known low specific speed pumps, i.e., pumps having specific speeds below about 600–700, loss in efficiency is primarily due to losses occasioned by frictional effects, although mixing losses tend to become a progressively greater loss factor as the specific speed of the pump increases. It will also be understood that frictional losses for pumps of any given type and size, which are provided with cast metal casings, are not constant, due to minor variations in size and surface finish of the chamber and throat areas of a pump typically encountered in such castings. As by way of example, for the case of $1\frac{1}{2} \times 2$–9 size pumps (the numerals designating discharge opening diameter, inlet opening diameter and nominal impeller diameter in inches) manufactured by Goulds Pumps, Incorporated of Seneca Falls, N.Y., individual pumps of a group of ten such pumps, will typically have actual performance efficiencies of between about 45 percent and 50 percent, thus creating an actual difference in efficiency between pumps of such group of about 10 percent. While the design efficiencies of a pump will vary directly with its discharge flow rate and/or specific speed, there still remains a range of differences in actual efficiencies obtained by pumps within a group of like size pumps. In that this variation is not acceptable, it is normally necessary to perform hand work on one or more of the pumps in order for them to meet desired minimum performance standards.

Again referring to FIG. 1, it will be understood that in accordance with the present invention, the interior of the casing of a given size of pump is cast oversize, as compared to a like sized known pump, so as to achieve a decrease in the velocity of fluid within pump chamber 14 and through the throat area of discharge passage 18. It has been found that for the previously mentioned $1\frac{1}{2}\times 2$–9 size pump, an increase of the size of pump chamber 14 effected by arranging points along boundary surface 26 at a distance from rotational axis 28, which are more than about 15 percent to 20 percent greater than the distance measured between 26' and such rotational axis, while maintaining the same axial dimension or width of the pump chamber and discharge passage, there may be achieved about a 15 percent decrease in flow velocity within the pump chamber, which is sufficient to substantially diminish frictional losses due to minor variations in size and surface finish normally found in casings of this size pump.

It is, of course, possible to further enlarge pump chamber 14 of any given size pump to achieve reductions in flow velocities of 50 percent or more, but there are certain practical limitations including the size of discharge pipe 22 and the cost of casting a casing having an exterior size sufficient to provide a safe casing wall thickness, as measured outwardly of boundary surface 26. In general, the relative percentage increase of the size of the interior of a pump will be required to increase as the specific speed of such pump decreases. Thus, for example, percentage increases in the range of 30 percent to 40 percent are contemplated as being required for pumps having specific speeds below about 450. This is due to the fact that interior flow velocities tend to increase as specific speed decreases. As by way of example, pumps having specific speeds of 70 and 450 may have internal velocities on the order of about 75 feet/-second and 125 feet/second, respectively. It is to be noted that the position of cut-water 30 and the radial distance between such cut-water and the periphery of impeller 24 or its rotational axis 28 remain unchanged from that of an unmodified or known pump.

As will be apparent, simply increasing the size of pump chamber 14 of any given size pump would serve to produce a much larger pump discharge flow rate than desired. Accordingly, in the present invention, a restrictor 34 is placed adjacent outlet end 20 of discharge passage 18 for purposes of throttling the output of the pump to a value equal to the design flow rate of the unmodified pump, i.e., the design flow rate resulting from a pump having a chamber and discharge passage boundary wall 26' determined by standard design criteria. Restrictor 34 is preferably formed by integrally casting a constriction adjacent the outlet end of discharge passage 18 and then machining an accurately sized flow opening or bore 36 therethrough, as by performing drilling and reaming operations. The constriction, as formed, may completely close the discharge passage, but is preferably formed with a small pilot hole to facilitate the machining operation. Frictional loss occasioned by flow opening 36 is relatively small, due to its relatively smooth machined surface and short axial length. The following examples of low specific speed pumps formed in accordance with the present invention and prior practice are given as by way of illustration:

| | New Design | | Prior Design | | | |
|---|---|---|---|---|---|---|
| Pump Size | Area of Restrictor | Area of Casing Throat | Area of Casing Throat | Spec. Speed (Ns) | Q (gpm) | Impeller type |
| $1\frac{1}{2}\times 2$–7 | .29 | .35 | .22 | 533 | 55 | closed |
| $1\frac{1}{2}\times 2$–9 | .60 | .61 | .39 | 508 | 120 | closed |
| $1\frac{1}{2}\times 3$–11 | .74 | .88 | .57 | 511 | 200 | closed |
| $1\times 2$–10 | .57 | .60 | .40 | 466 | 180 | open |
| $2\times 3$–13 | 1.23 | 1.66 | .81 | 500 | 350 | closed |

It will be understood that pump size per se is not limited on this present invention, as long as the pump has a relatively low specific speed at which sufficient variations in frictional losses between like sized pumps warrant practice of the present invention.

By increasing the size of the pump chamber and discharge passage and employing an accurately sized flow opening, as opposed to throat area 32 as in conventional pumps, to limit the flow rate to a desired value, two advantages are obtained; namely, the overall loss due to friction is substantially reduced and the variation in frictional losses within a group of like pumps is substantially diminished, as indicated in FIG. 4. On the other hand, an obvious disadvantage of increasing the size of the pump chamber is that mixing losses substantially increase, also as indicated in FIG. 4. However, it has been found that the net effect of these decreased and increased losses due to friction and mixing, respectively, is advantageous for the case of low specific speed pumps. In this respect, it has been determined that for the type of pump under consideration, the reduction in frictional loss and the increase in mixing loss tend to balance each other with some possible small increase in overall pump efficiency being noted. However, of more importance is the fact that the variation in total loss between like pumps is substantially decreased. Thus, for the case of the $1\frac{1}{2}\times 2$–9 size pump mentioned above, conventionally formed pumps will have actual efficiencies typically varying between 45 percent and 50 percent within a given group of such pumps, whereas like pumps formed in accordance with the present invention will have actual efficiencies varying between 49 percent and 50 percent, with some pumps appearing to even slightly exceed the design efficiency of 50 percent. The operating characteristics of the improved and unmodified or known pumps will otherwise be essentially the same. Thus, the primary advantage of the present invention, is that pumps having efficiencies lying within a relatively small range of acceptable manufacturing tolerances may be consistently manufactured without resorting to hand machining of individual pumps to bring same within acceptable tolerances.

A further advantage flowing from the practice of the present invention is that a given size pump may be modified to provide a family of pumps having different characteristics by merely varying the diameter of the restrictor flow opening. Thus, as by way of example, the $1\frac{1}{2}\times 2$–9 size pump may be used to create a family of pumps having for instance maximum flow rates of about 120 gpm, 110 gpm and 70 gpm by providing restrictor flow openings of $\frac{7}{8}$ inch, 13/16 inch and 11/16 inch, respectively. Of course, the actual efficiency of the 110 gpm and 70 gpm pumps will be less than the actual efficiency of the 120 gpm pump, but the percentage of efficiency variation within any group of such smaller output pumps will remain sufficiently small, so as to permit consistent manufacture thereof without hand working of individual pumps to bring same within acceptable tolerances.

While in accordance with the presently preferred form of the invention, the internal size of a pump is changed by increasing only its radial dimension, it is contemplated that an increase in size may be obtained, if desired, by increasing both the radial and axial dimensions or only the axial dimension of the pump chamber and discharge passage.

We claim:

1. A low specific speed centrifugal pump having a desired discharge flow rate, which comprises in combination:

a casing of cast metal construction defining a pump chamber, an inlet opening, a discharge passage having an inlet end communicating with said chamber and an outlet end, and a constriction extending across said outlet end, said pump chamber having an outer boundary surface extending away from a cut-water and about said pump chamber to a point at which it cooperates with said cut-water to define said inlet end of said discharge passage, said constriction having a restrictor flow opening entending therethrough in flow communication with said discharge passage; and an impeller supported for rotation about an axis within said chamber for transporting fluid between said inlet opening and said outlet end, said chamber and discharge passage leading to said restriction having a size sufficient to provide an other pump discharge flow rate exceeding said desired flow rate by arranging said outer boundary surface at a radial distance from said axis which is greater than that required to provide said desired flow rate, the radial distance between said cut-water and said axis corresponding to that required to provide said desired discharge flow rate, and said restrictor flow opening throttles said pump to reduce said other flow rate to said desired flow rate.

2. In a method of manufacturing a group of low specific speed centrifugal pumps, comprising the steps of casting like sized pump casings to define pump chambers, inlet openings communicating with said chambers and discharge passages having throat areas communicating with said chambers and outlet ends, said pump chambers having outer boundary surfaces extending away from cut-waters and about said pump chambers for cooperation with said cut-waters to define said throat areas, and fitting said casings with impellers supported for rotation about an axis within each of said chambers for transporting fluid between said inlet openings and said outlet ends, characterized in that said pumps of said group have a design discharge flow rate for any given size impeller, chamber, discharge passage and radial spacing between said cut-waters and said axis, and in that pumps of said group vary in overall efficiency due to variations in surface finish of said chambers and throat areas as a result of casting of said casings; the improvement for reducing variations in overall efficiency between pumps of said group comprising:

increasing the size of each of said chambers and said discharge passages, including said throat areas, by increasing the radial distance between said boundary surfaces and said axis beyond that required to provide said pumps with said design discharge flow rate, while maintaining essentially said given radial spacing between said cut-waters and said axis; and providing restrictions within said discharge passages at said outlet ends, said restrictions having uniformly sized restrictor flow openings therethrough serving to limit the discharge flow rate from said pumps to essentially said design discharge flow rate.

3. A group of low specific speed centrifugal pumps formed by the method of claim 2.

4. An improvement in the method of manufacturing a low specific speed centrifugal pump including the steps of casting a casing from metal to define a pump chamber, an inlet communicating with the chamber and a discharge passage having a throat end communicating with said chamber and an outlet end, and fitting said casing with an impeller supported for rotation about an axis within the chamber for transporting fluid from said inlet opening to said outlet end, wherein said pump chamber has an outer boundary surface extending away from a cut-water and about said pump chamber for cooperation with said cut-water to define said throat end, and wherein surfaces of said chamber and said discharge passage including said throat have an as-cast surface finish tending to produce frictional losses during operation of said pump, and wherein said pump is characterized as having a design discharge flow rate for any given size impeller, chamber, discharge passage and radial spacing between said cut-water and said axis, said improvement tending to reduce said frictional losses of said pump comprising:

forming said chamber and said discharge passage including said throat end of a size exceeding that required to provide said design discharge flow rate and to reduce said losses by increasing the radial distance between said boundary surface and said axis while maintaining essentially said given radial distance between said cut-water and said axis; and providing a restriction adjacent said outlet end having a flow opening extending therethrough sized to throttle discharge flow from said pump to said design discharge flow rate.

5. A low specific speed centrifugal pump formed by the method of claim 4.

6. An improvement in the method of manufacturing a group of low specific speed centrifugal pumps, wherein pumps forming said group have decreasing discharge flow rates relative to a given discharge flow rate, including the steps of forming a group of like sized pump casings to define pump chambers, pump inlets communicating with said pump chambers and pump discharge passages having throat ends communicating with said pump chambers and outlet ends, fitting said casings with impellers rotatably supported within said pump casings for rotation about axes of rotation, and providing restrictor openings in said discharge passages to provide said decreasing discharge flow rates, wherein said pump chambers have outer boundary surfaces disposed radially outwardly of said axis to extend away from cut-waters and about said pump chambers for cooperating with said cut-waters to define said throat ends and wherein surfaces of said pump chambers and passages have as-formed surface finishes tending to produce frictional losses during operation of said pumps, which vary between pumps having any given size restrictor opening; said improvement including:

forming said pump chambers and passages, including said throat ends, of a size sufficient to provide another discharge flow rate exceeding said given discharge flow rate and to reduce said losses by uniformly increasing the radial distance between said boundary surfaces and said axes while maintaining a radial distance between said cut-waters and said axes corresponding to that required to provide said given discharge flow rate; and sizing said restrictor openings to reduce said discharge flow rate from said other discharge flow rate to and below said given discharge flow rate.

7. A group of low specific speed centrifugal pumps formed by the method of claim 6.

8. In a method of manufacturing a group of low specific speed centrifugal pumps, comprising the steps of casting like sized pump casings to define pump chambers, inlet openings communicating with said chambers and discharge passages having throat areas communicating with said chambers and outlet ends, said pump chambers having outer boundary surfaces extending away from cut-waters and about said pump chambers for cooperation with said cut-waters to define said throat areas, and fitting said casings with impellers supported for rotation about an axis within each of said chambers for transporting fluid between said inlet openings and said outlet ends, characterized in that said pumps of said group have a design discharge flow rate for any given size impeller, chamber, discharge passage and radial spacing between said cut-waters and said axis, and in that pumps of said group vary in overall efficiency due to variations in surface finish of said chambers and throat areas as a result of casting of said casings; the improvement for reducing variations in overall efficiency between pumps of said group comprising:

increasing the size of each of said chambers and said discharge passages, including said throat areas beyond that required to provide said pumps with said design discharge flow rate, while maintaining essentially said given radial spacing between said cut-waters and sid axis; and providing restrictions within said discharge passages having uniformly sized restrictor flow openings therethrough serving to limit the discharge flow rate from said pumps to essentially said design discharge flow rate.

9. A group of low specific speed centrifugal pumps formed by the method of claim 8.

10. An improvement in the method of manufacturing a low specific speed centrifugal pump including the steps of casting a casing from metal to define a pump chamber, an inlet communicating with the chamber and a discharge passage having a throat end communicating with said chamber and an outlet end, and fitting said casing with an impeller supported for rotation about an axis within the chamber for transporting fluid from said inlet opening to said outlet end, wherein said pump chamber has an outer boundary surface extending away from a cut-water and about said pump chamber for cooperation with said cut-water to define said throat end, wherein surfaces of said chamber and said discharge passage including said throat have an as-cast surface finish tending to produce frictional losses during operation of said pump, and wherein said pump is characterized as having a design discharge flow rate for any given size impeller, chamber, discharge passage and radial spacing between said cut-water and said axis, said improvement tending to reduce said frictional losses of said pump comprising:

forming said chamber and said discharge passage including said throat end of a size exceeding that required to provide said design discharge flow rate while maintaining essentially said given radial distance between said cut-water and said axis; and providing a restriction in said discharge passage having a flow opening extending therethrough sized to throttle discharge flow from said pump to said design discharge flow rate.

11. A low specific speed centrifugal pump formed by the method of claim 10.

12. An improvement in the method of manufacturing a group of low specific speed centrifugal pumps, wherein pumps forming said group have decreasing discharge flow rates relative to a given discharge flow rate, including the steps of forming a group of like sized pump casings to define pump chambers, pump inlets communicating with said pump chambers and pump discharge passages having throat ends communicating with said pump chambers and outlet ends, fitting said casings with impellers rotatably supported within said pump casings for rotation about axes of rotation, and providing restrictor openings in said discharge passages to provide said decreasing discharge flow rates, wherein said pump chambers have outer boundary surfaces disposed radially outwardly of said axis to extend away from cut-waters and about said pump chambers for cooperating with said cut-waters to define said throat ends and wherein surfaces of said pump chambers and passages have as-formed surface finishes tending to produce frictional losses during operation of said pumps, which vary between pumps having any given size restrictor opening; said improvement including:

forming said pump chambers and passages, including said throat ends, of a size sufficient to provide another discharge flow rate exceeding said given discharge flow rate and to reduce said losses while maintaining a radial distance between said cut-waters and said axes corresponding to that required to provide said given discharge flow rate; and sizing said restrictor openings to reduce said discharge flow ratefrom said other discharge flow rate to and below said given discharge flow rate.

13. A group of low specific speed centrifugal pumps formed by the method of claim 12.

* * * * *